US010882052B2

(12) United States Patent
Cook et al.

(10) Patent No.: US 10,882,052 B2
(45) **Date of Patent: *Jan. 5, 2021**

(54) LOOSEFILL INSULATION BLOWING MACHINE WITH REMOVABLE HOSE HUB

(71) Applicant: Owens Corning Intellectual Capital, LLC, Toledo, OH (US)

(72) Inventors: David M. Cook, Granville, OH (US); Brandon Robinson, Sylv ania, OH (US); Mark E. Mnich, Westerville, OH (US); Ryan S. Crisp, Lewis Center, OH (US); Christopher M. Relyea, Marysville, OH (US); Terry Finklea, Upper Arlington, OH (US); Chris W. Cicenas, Etna, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1148 days.

This patent is subject to a terminal disclaimer.

(21) Appl. No.: 15/167,115

(22) Filed: May 27, 2016

(65) Prior Publication Data

US 2016/0354788 A1 Dec. 8, 2016

Related U.S. Application Data

(60) Provisional application No. 62/169,658, filed on Jun. 2, 2015.

(51) Int. Cl.
*B02C 18/22* (2006.01)
*E04F 21/08* (2006.01)

(52) U.S. Cl.
CPC ..... *B02C 18/2291* (2013.01); *B02C 18/2216* (2013.01); *E04F 21/085* (2013.01)

(58) Field of Classification Search
CPC ..... B02C 18/2291; B02C 18/2216; B02C 2201/066; E04F 21/085; A47L 9/0036; A47L 5/14; A01G 3/002
(Continued)

(56) References Cited

U.S. PATENT DOCUMENTS 3,651,536 A 3/1972 Bolzan, Jr. et al.
4,513,772 A 4/1985 Fisher
(Continued)

FOREIGN PATENT DOCUMENTS

EP 0808642 A1 11/1997

OTHER PUBLICATIONS

Modern Mechanix (Year: 1929).*

*Primary Examiner* — Shelley M Self
*Assistant Examiner* — Smith Oberto Bapthelus
(74) *Attorney, Agent, or Firm* — MacMillan, Sobanski & Todd, LLC

(57) ABSTRACT

A machine for distributing blowing insulation material from a package of compressed loosefill insulation material is provided. The machine includes a chute having an inlet end and outlet end. The inlet end is configured to receive the package of compressed loosefill insulation material. The chute further has a removable hose hub extending within the interior of the chute. The removable hose hub is configured for wrapping with a distribution hose. A lower unit is configured to receive the compressed loosefill insulation material exiting the outlet end of the chute. The lower unit includes a plurality of shredders and a discharge mechanism. The discharge mechanism is configured to discharge conditioned loosefill insulation material into an airstream.

20 Claims, 13 Drawing Sheets

(58) Field of Classification Search
USPC ..... 241/60
See application file for complete search history.

(56) References Cited

U.S. PATENT DOCUMENTS

| | | | | |
|---|---|---|---|---|
| 4,739,535 | A | 4/1988 | Schuld et al. | |
| 4,903,911 | A | 2/1990 | Sepke | |
| 4,993,449 | A | 2/1991 | Stutzman et al. | |
| 5,526,842 | A | 6/1996 | Christensen | |
| 6,105,604 | A * | 8/2000 | Furness | A62C 33/04 137/355.16 |
| 6,260,233 | B1 | 7/2001 | Wareham et al. | |
| 6,503,026 | B1 | 1/2003 | Mitchell | |
| 6,672,329 | B1 | 1/2004 | Brooks et al. | |
| 6,802,336 | B1 | 10/2004 | Holmquist | |
| 7,316,368 | B2 | 1/2008 | Moon et al. | |
| 7,938,348 | B2 * | 5/2011 | Evans | B65B 69/0008 241/60 |
| 8,556,200 | B2 | 10/2013 | Piotrowski et al. | |
| 8,807,157 | B2 | 8/2014 | Simpson et al. | |
| 2002/0053625 | A1 * | 5/2002 | Charlton | B65H 75/22 242/608.5 |
| 2007/0119015 | A1 | 5/2007 | Leslie et al. | |
| 2007/0209711 | A1 | 9/2007 | Morgan et al. | |
| 2008/0087752 | A1 * | 4/2008 | Johnson | E04F 21/085 241/80 |
| 2008/0282496 | A1 | 11/2008 | Matsumoto | |

* cited by examiner

LOOSEFILL INSULATION BLOWING MACHINE WITH REMOVABLE HOSE HUB

RELATED APPLICATIONS

This application claims priority from U.S. Provisional Patent Application No. 62/169,658, filed Jun. 2, 2015, the disclosure of which is incorporated herein by reference in its entirety.

BACKGROUND

When insulating buildings and installations, a frequently used insulation product is loosefill insulation material. In contrast to the unitary or monolithic structure of insulation materials formed as batts or blankets, loosefill insulation material is a multiplicity of discrete, individual tufts, cubes, flakes or nodules. Loosefill insulation material is usually applied within buildings and installations by blowing the loosefill insulation material into an insulation cavity, such as a wall cavity or an attic of a building. Typically loosefill insulation material is made of glass fibers although other mineral fibers, organic fibers, and cellulose fibers can be used.

Loosefill insulation material, also referred to as blowing wool, is typically compressed in packages for transport from an insulation manufacturing site to a building that is to be insulated. Typically the packages include compressed loosefill insulation material encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of loosefill insulation material into an insulation cavity typically uses an insulation blowing machine that can condition the loosefill insulation material to a desired density and feed the conditioned loosefill insulation material pneumatically through a distribution hose. The distribution hoses can be lengthy and cumbersome when the insulation blowing machine is not in use.

It would be advantageous if insulation blowing machines could be improved to make them easier to use.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the loosefill insulation blowing machine with a removable hose hub.

The above objects as well as other objects not specifically enumerated are achieved by a machine for distributing blowing insulation material from a package of compressed loosefill insulation material. The machine includes a chute having an inlet portion and outlet portion. The inlet portion is configured to receive the package of compressed loosefill insulation material. The chute further has a removable hose hub extending within the interior of the chute. The removable hose hub is configured for wrapping with a distribution hose. A lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream.

There is also provided a machine for distributing blowing insulation material from a package of compressed loosefill insulation material. The machine includes a chute having an inlet end and outlet end. The inlet end is configured to receive the package of compressed loosefill insulation material. A removable hose hub is installed in the chute. A lower unit is configured to receive the compressed loosefill insulation material exiting the outlet end of the chute. The lower unit includes a plurality of shredders and a discharge mechanism. The discharge mechanism is configured to discharge conditioned loosefill insulation material into an airstream. The machine is configured for a storage mode with the hose hub installed in the chute and a distribution hose wrapped around the hose hub. The machine is configured for an operational mode with the hose hub removed from the machine.

There is also provided a method of using and storing a machine for distributing blowing insulation material from a package of compressed loosefill insulation material. The method includes the steps of configuring a machine with a chute, a hose hub and a lower unit, the chute having an inlet end and outlet end, the inlet end configured to receive the package of compressed loosefill insulation material, the hose hub configured to receive and support accumulated wrappings of a distribution hose, the lower unit configured to receive the compressed loosefill insulation material exiting the outlet end of the chute, the lower unit including a plurality of shredders and a discharge mechanism, the discharge mechanism configured to discharge conditioned loosefill insulation material into an airstream, configuring the machine for a storage mode with the hose hub installed in the chute and a distribution hose wrapped around the hose hub and configuring the machine for an operational mode with the hose hub removed from the machine.

Various objects and advantages of the loosefill insulation blowing machine with a removable hose hub will become apparent to those skilled in the art from the following detailed description, when read in light of the accompanying drawings.

DETAILED DESCRIPTION

Figure 1:
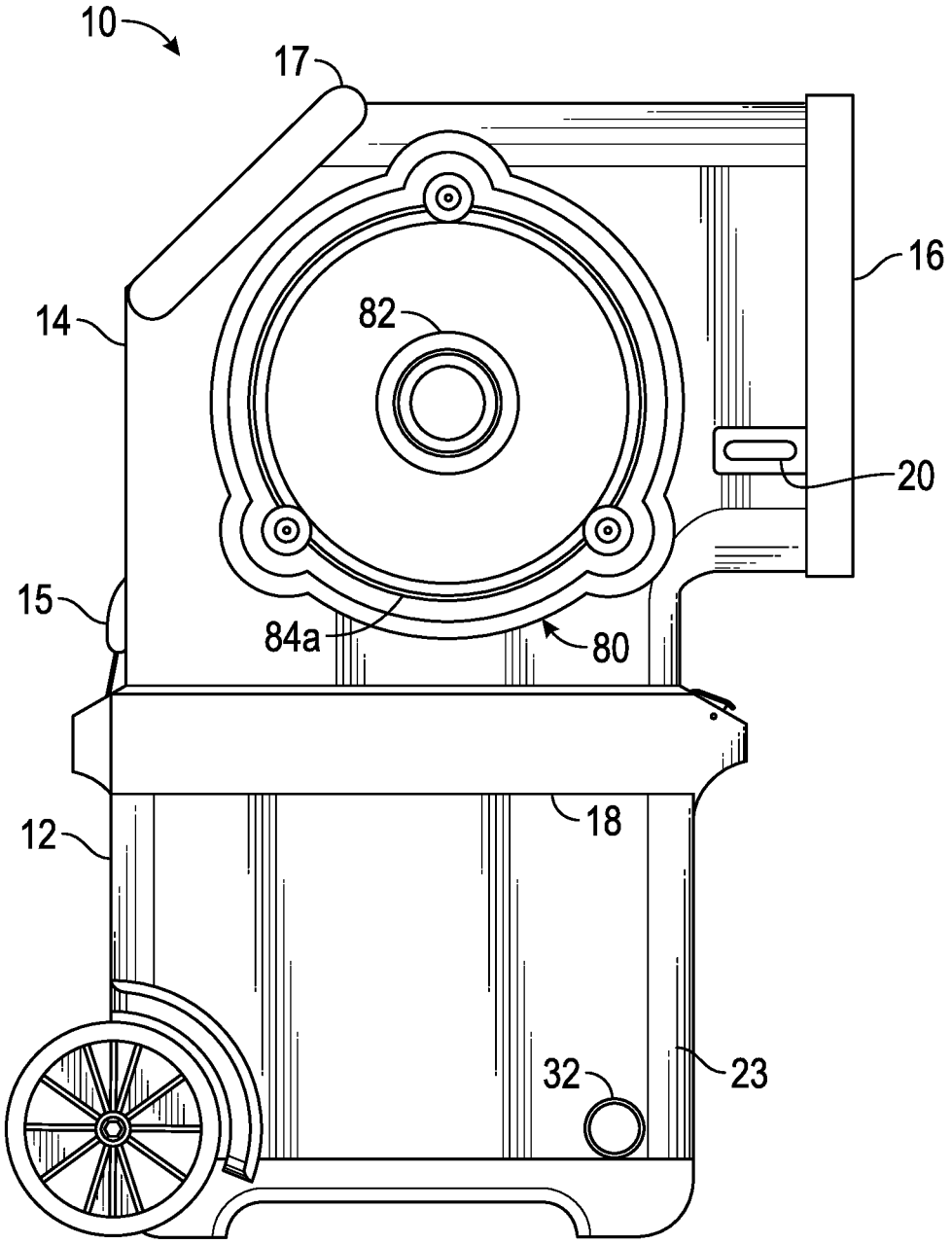
FIG. 1 is a front view, in elevation, of a loosefill insulation blowing machine.

The loosefill insulation blowing machine with a removable hose hub will now be described with occasional reference to specific embodiments. The loosefill insulation blowing machine with a removable hose hub may, however, be embodied in different forms and should not be construed as limited to the embodiments set forth herein. Rather, these embodiments are provided so that this disclosure will be thorough and complete, and will fully convey the scope of the loosefill insulation blowing machine with a removable hose hub to those skilled in the art.

Unless otherwise defined, all technical and scientific terms used herein have the same meaning as commonly understood by one of ordinary skill in the art to which the loosefill insulation blowing machine with a removable hose hub belongs. The terminology used in the description of the loosefill insulation blowing machine with a removable hose hub herein is for describing particular embodiments only and is not intended to be limiting of the loosefill insulation blowing machine with a removable hose hub. As used in the description of the loosefill insulation blowing machine with a removable hose hub and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the loosefill insulation blowing machine with a removable hose hub. Notwithstanding that the numerical ranges and parameters setting forth the broad scope of the loosefill insulation blowing machine with a removable hose hub are approximations, the numerical values set forth in the specific examples are reported as precisely as possible. Any numerical values, however, inherently contain certain errors necessarily resulting from error found in their respective measurements.

In accordance with illustrated embodiments, the description and figures disclose a loosefill insulation blowing machine having a removable hose hub positioned within a chute. The removable hose hub is configured to receive and store a distribution hose within the chute. With the blowing machine in an operational mode, the distribution hose is removed from the chute by unwrapping the hose from the hose hub. The hose hub is subsequently removed from the chute, thereby allowing the chute to receive a package of compressed loosefill insulation material for conditioning and in turn, distribution through the distribution hose. With the blowing machine in a storage mode, the hose hub is installed to extend through the chute, thereby allowing wrapping of the distribution hose on the portion of the hose hub positioned within the chute.

The term "loosefill insulation material", as used herein, is defined to mean any insulating material configured for distribution in an airstream. The term "finely conditioned", as used herein, is defined to mean the shredding, picking apart and conditioning of loosefill insulation material to a desired density prior to distribution into an airstream.

Figure 2:
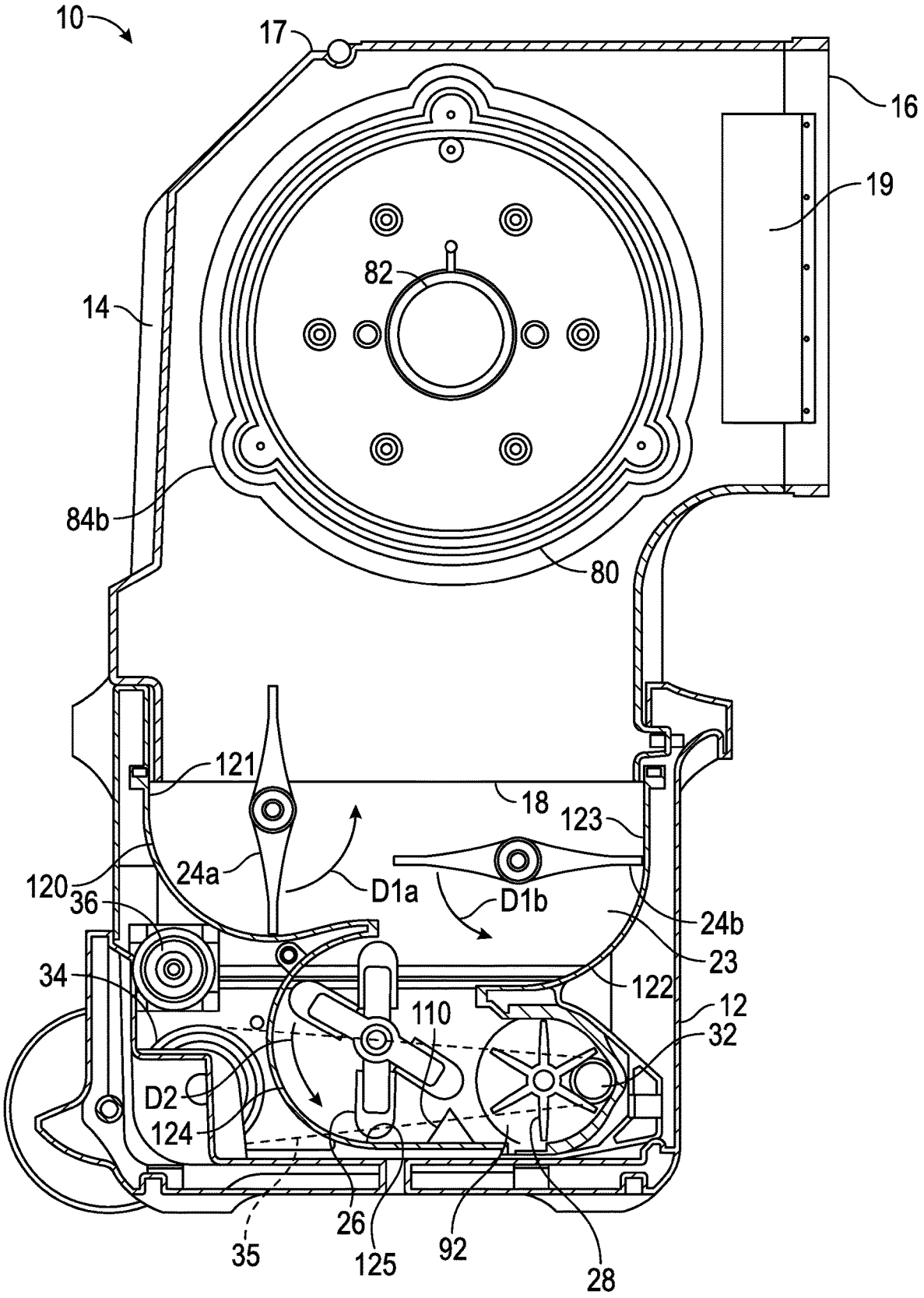
FIG. 2 is a front view, in elevation, partially in cross-section, of the loosefill insulation blowing machine of FIG. 1.
Figure 3:
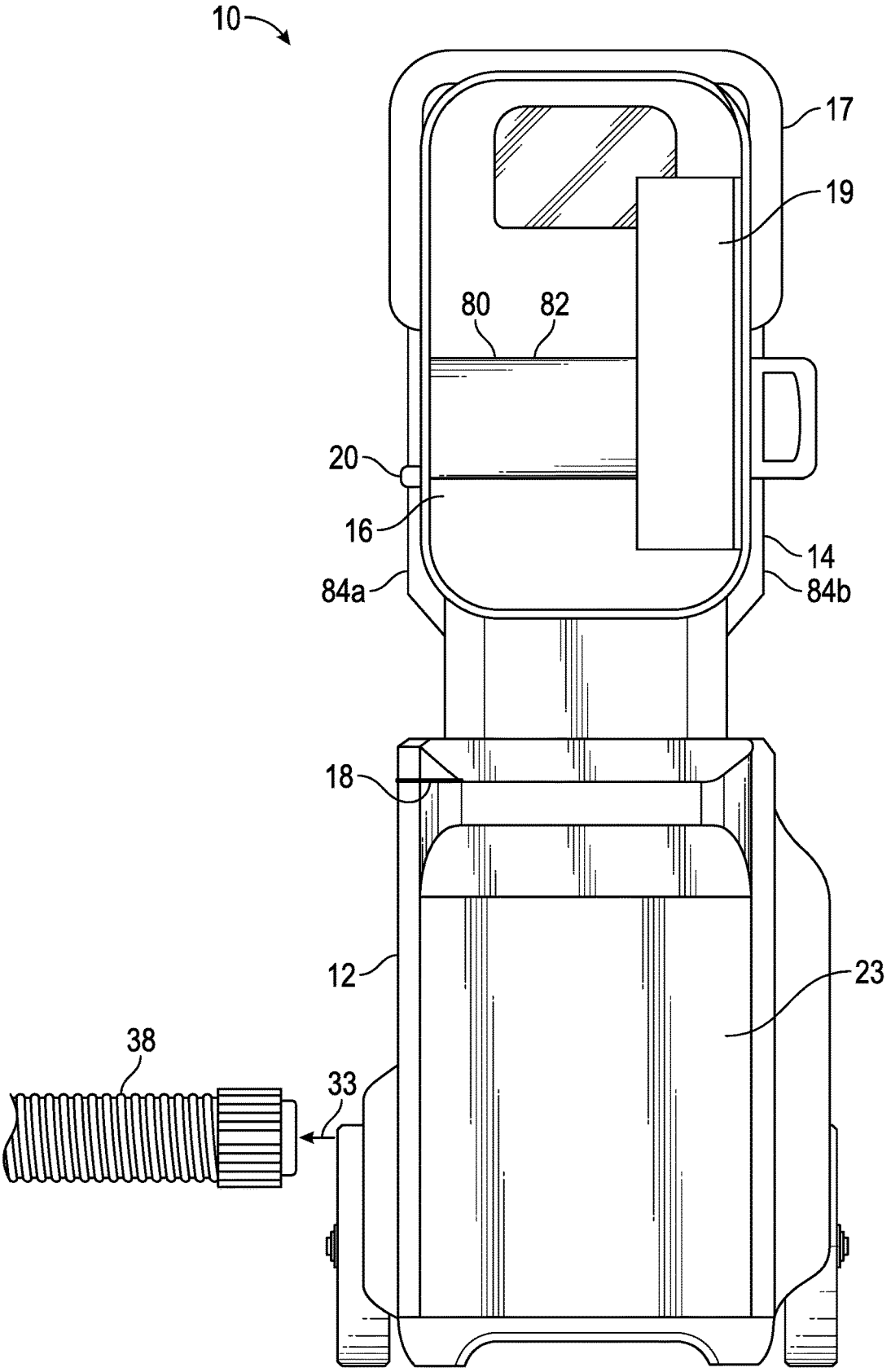
FIG. 3 is a side view, in elevation, of the loosefill insulation blowing machine of FIG. 1.

Referring now to FIGS. 1-3, a loosefill insulation blowing machine (hereafter "blowing machine") is shown generally at 10. The blowing machine 10 is configured for conditioning compressed loosefill insulation material and further configured for distributing the conditioned loosefill insulation material to desired locations, such as for example, insulation cavities. The blowing machine 10 includes a lower unit 12 and a chute 14. The lower unit 12 is connected to the chute 14 by one or more fastening mechanisms 15, configured to readily assemble and disassemble the chute 14 to the lower unit 12. The chute 14 has an inlet end 16 and an outlet end 18.

Referring again to FIGS. 1-3, the inlet end 16 of the chute 14 is configured to receive compressed loosefill insulation material typically contained within a package (not shown for purposes of clarity). As the package of compressed loosefill insulation material is guided into an interior of the chute 14, the cross-sectional shape and size of the chute 14 relative to the cross-sectional shape and size of the package of compressed loosefill insulation material directs an expansion of the compressed loosefill insulation material to a direction toward the outlet end 18, wherein the loosefill insulation material is introduced to a shredding chamber 23 positioned in the lower unit 12.

Referring again to FIGS. 1-3, optionally the chute 14 can include one or more handle segments 17, configured to facilitate ready movement of the blowing machine 10 from one location to another. The handle segment 17 can have any desired structure and configuration. However, it should be understood that the one or more handle segments 17 are not necessary to the operation of the blowing machine 10.

Referring again to FIGS. 1-3, the chute 14 includes a bail guide 19, mounted at the inlet end 16 of the chute 14. The bail guide 19 is configured to urge a package of compressed loosefill insulation material against a cutting mechanism 20 as the package of compressed loosefill insulation material moves further into the interior of the chute 14. The bail guide 19 and the cutting mechanism 20 can have any desired structure.

Referring again to FIGS. 1-3, the chute 14 includes a distribution hose storage assembly 80. The distribution hose storage assembly 80 is configured to store a distribution hose 38 within the chute 14 when the blowing machine 10 is not in use and portions of the distribution hose storage assembly 80 are further configured for removal from the chute 14 when the blowing machine 10 is in use. The distribution hose storage assembly 80 will be discussed in more detail below.

Referring now to FIG. 2, the shredding chamber 23 is mounted in the lower unit 12, downstream from the outlet end 18 of the chute 14. The shredding chamber 23 can include a plurality of low speed shredders 24*a*, 24*b* and one or more agitators 26. The low speed shredders 24*a*, 24*b* are configured to shred, pick apart and condition the loosefill insulation material as the loosefill insulation material is discharged into the shredding chamber 23 from the outlet end 18 of the chute 14. The one or more agitators 26 are configured to finely condition the loosefill insulation material to a desired density as the loosefill insulation material exits the low speed shredders 24*a*, 24*b*. It should be appreciated that any quantity of low speed shredders and agitators can be used. Further, although the blowing machine 10 is described with low speed shredders and agitators, any type or combination of separators, such as clump breakers, beater bars or any other mechanisms, devices or structures that shred, pick apart, condition and/or finely condition the loosefill insulation material can be used.

Referring again to the embodiment shown in FIG. 2, the agitator 26 is positioned vertically below the low speed shredders 24*a*, 24*b*. Alternatively, the agitator 26 can be positioned in any location relative to the low speed shredders 24*a*, 24*b*, such as horizontally adjacent to the low speed shredders 24*a*, 24*b*, sufficient to finely condition the loosefill insulation material to a desired density as the loosefill insulation material exits the low speed shredders 24*a*, 24*b*.

In the embodiment illustrated in FIG. 2, the low speed shredders 24*a*, 24*b* rotate in a counter-clockwise direction, as shown by direction arrows D1*a*, D1*b* and the one or more agitators 26 also rotate in a counter-clockwise direction, as shown by direction arrow D2. Rotating the low speed shredders 24*a*, 24*b* and the agitator 26 in the same counter-clockwise directions, D1*a*, D1*b* and D2, allows the low speed shredders 24*a*, 24*b* and the agitator 26 to shred and pick apart the loosefill insulation material while substantially preventing an accumulation of unshredded or partially shredded loosefill insulation material in the shredding chamber 23. However, in other embodiments, the low speed shredders 24*a*, 24*b* and the agitator 26 could rotate in a clock-wise direction or the low speed shredders 24*a*, 24*b* and the agitator 26 could rotate in different directions provided an accumulation of unshredded or partially shredded loosefill insulation material does not occur in the shredding chamber 23.

Referring again to the embodiment shown in FIG. 2, the low speed shredders 24*a*, 24*b* rotate at a lower rotational speed than the agitator 26. The low speed shredders 24*a*, 24*b* rotate at a speed of about 40-80 revolutions per minute (rpm) and the agitator 26 rotates at a speed of about 300-500 rpm. In another embodiment, the low speed shredders 24*a*, 24*b* can rotate at a speed less than about 40-80 rpm, provided the speed is sufficient to shred and pick apart the loosefill insulation material. In still other embodiments, the agitator 26 can rotate at a speed less than or more than 300-500 rpm provided the speed is sufficient to finely shred the loosefill insulation material and prepare the loosefill insulation material for distribution into an airstream.

Referring again to FIG. 2, the shredding chamber 23 includes a first guide shell 120 positioned partially around the low speed shredder 24*a*. The first guide shell 120 extends to form an arc of approximately 90°. The first guide shell 120 has an inner surface 121. The first guide shell 120 is configured to allow the low speed shredder 24*a* to seal against the inner surface 121 and thereby direct the loosefill insulation material in a downstream direction as the low speed shredder 24*a* rotates.

Referring again to FIG. 2, the shredding chamber 23 includes a second guide shell 122 positioned partially around the low speed shredder 24*b*. The second guide shell 122 extends to form an arc of approximately 90°. The second guide shell 122 has an inner surface 123. The second guide shell 122 is configured to allow the low speed shredder 24*b* to seal against the inner surface 123 and thereby direct the loosefill insulation material in a downstream direction as the low speed shredder 24*b* rotates.

Referring again to FIG. 2, the shredding chamber 23 includes a third guide shell 124 positioned partially around the agitator 26. The third guide shell 124 extends to form an approximate semi-circle. The third guide shell 124 has an inner surface 125. The third guide shell 124 is configured to allow the agitator 26 to seal against the inner surface 125 and thereby direct the finely conditioned loosefill insulation material in a downstream direction as the agitator 26 rotates.

In the embodiment shown in FIG. 2, the inner surfaces 121, 123 and 125, are formed from a high density polyethylene material (hdpe) configured to provide a lightweight, low friction sealing surface and guide for the loosefill insulation material. Alternatively, the inner surfaces 121, 123 and 125 can be formed from other materials, such as aluminum, sufficient to provide a lightweight, low friction sealing surface and guide that allows the low speed shredders 24*a*, 24*b* and the agitator 26 to direct the loosefill insulation material downstream.

Referring again to FIG. 2, a discharge mechanism, shown schematically at 28, is positioned downstream from the one or more agitators 26 and is configured to distribute the finely conditioned loosefill insulation material exiting the agitator 26 into an airstream, shown schematically by arrow 33 in FIG. 3. In the illustrated embodiment, the discharge mechanism 28 is a rotary valve. In other embodiments, the discharge mechanism 28 can be other structures, mechanisms and devices, such as for example staging hoppers, metering devices or rotary feeders, sufficient to distribute the finely conditioned loosefill insulation material into the airstream 33.

Referring again to FIG. 2, the finely conditioned loosefill insulation material is driven through the discharge mechanism 28 and through a machine outlet 32 by the airstream 33. The airstream 33 is provided by a blower 34 and associated ductwork, shown in phantom at 35. In alternate embodiments, the airstream 33 can be provided by other structures and manners, such as by a vacuum, sufficient to provide the airstream 33 through the discharge mechanism 28.

Referring again to FIG. 2, the low speed shredders 24*a*, 24*b*, agitator 26 and discharge mechanism 28 are mounted for rotation. In the illustrated embodiment, they are driven by an electric motor 36 and associated drive means (not shown). However, in other embodiments, the low speed shredders 24*a*, 24*b*, agitator 26 and discharge mechanism 28 can be driven by any suitable means. In still other embodiments, each of the low speed shredders 24*a*, 24*b*, agitator 26 and discharge mechanism 28 can be provided with its own source of rotation. In the illustrated embodiment, the electric motor 36 driving the low speed shredders 24*a*, 24*b*, agitator 26 and discharge mechanism 28 is configured to operate on a single 15 ampere, 110 volt a.c. electrical power supply. In other embodiments, other suitable power supplies can be used.

Referring again to FIG. 2, the discharge mechanism 28 is configured with a side inlet 92. The side inlet 92 is configured to receive the finely conditioned loosefill insulation material as it is fed in a substantially horizontal direction from the agitator 26. In this embodiment, the side inlet 92 of the discharge mechanism 28 is positioned to be horizontally adjacent to the agitator 26. In another embodiment, a low speed shredder 24*a* or 24*b*, or a plurality of low speed shredders 24*a*, 24*b* or agitators 26, or other shredding mechanisms can be horizontally adjacent to the side inlet 92 of the discharge mechanism 28 or in other suitable positions.

Referring again to FIG. 2, a choke 110 is positioned between the agitator 26 and the discharge mechanism 28. In this position, the choke 110 is configured to allow finely conditioned loosefill insulation material to enter the side inlet 92 of the discharge mechanism 28 and redirect heavier clumps of conditioned loosefill insulation material past the side inlet 92 of the discharge mechanism 28 and back to the low speed shredders, 24*a* and 24*b*, for further conditioning. In the illustrated embodiment, the choke 110 has a substantially triangular cross-sectional shape. However, the choke 110 can have other cross-sectional shapes sufficient to allow finely conditioned loosefill insulation material to enter the side inlet 92 of the discharge mechanism 28 and redirect heavier clumps of conditioned loosefill insulation material past the side inlet 92 of the discharge mechanism 28 and back to the low speed shredders, 24*a* and 24*b*, for further conditioning.

Referring again to FIG. 2, in operation, the inlet end 16 of the chute 14 receives a package of compressed loosefill insulation material. As the package of compressed loosefill insulation material moves into the chute 14, the bale guide 19 urges the package against the cutting mechanism 20, thereby cutting an outer protective covering and allowing the compressed loosefill insulation within the package to expand. As the compressed loosefill insulation material expands within the chute 14, the chute 14 directs the expanding loosefill insulation material past the outlet end 18 of the chute 14 and into the shredding chamber 23. The low speed shredders 24*a*, 24*b* receive the loosefill insulation material and shred, pick apart and condition the loosefill insulation material. The loosefill insulation material is directed by the low speed shredders 24*a*, 24*b* to the agitator 26. The agitator 26 is configured to finely condition the loosefill insulation material and prepare the loosefill insulation material for distribution into the airstream 33 by further shredding and conditioning the loosefill insulation material. The finely conditioned loosefill insulation material exits the agitator 26 and enters the discharge mechanism 28 for distribution into the airstream 33 provided by the blower 34. The airstream 33, entrained with the finely conditioned loosefill insulation material, exits the insulation blowing machine 10 at the machine outlet 32 and flows through the distribution hose 38 toward an insulation cavity (not shown).

Figure 4:
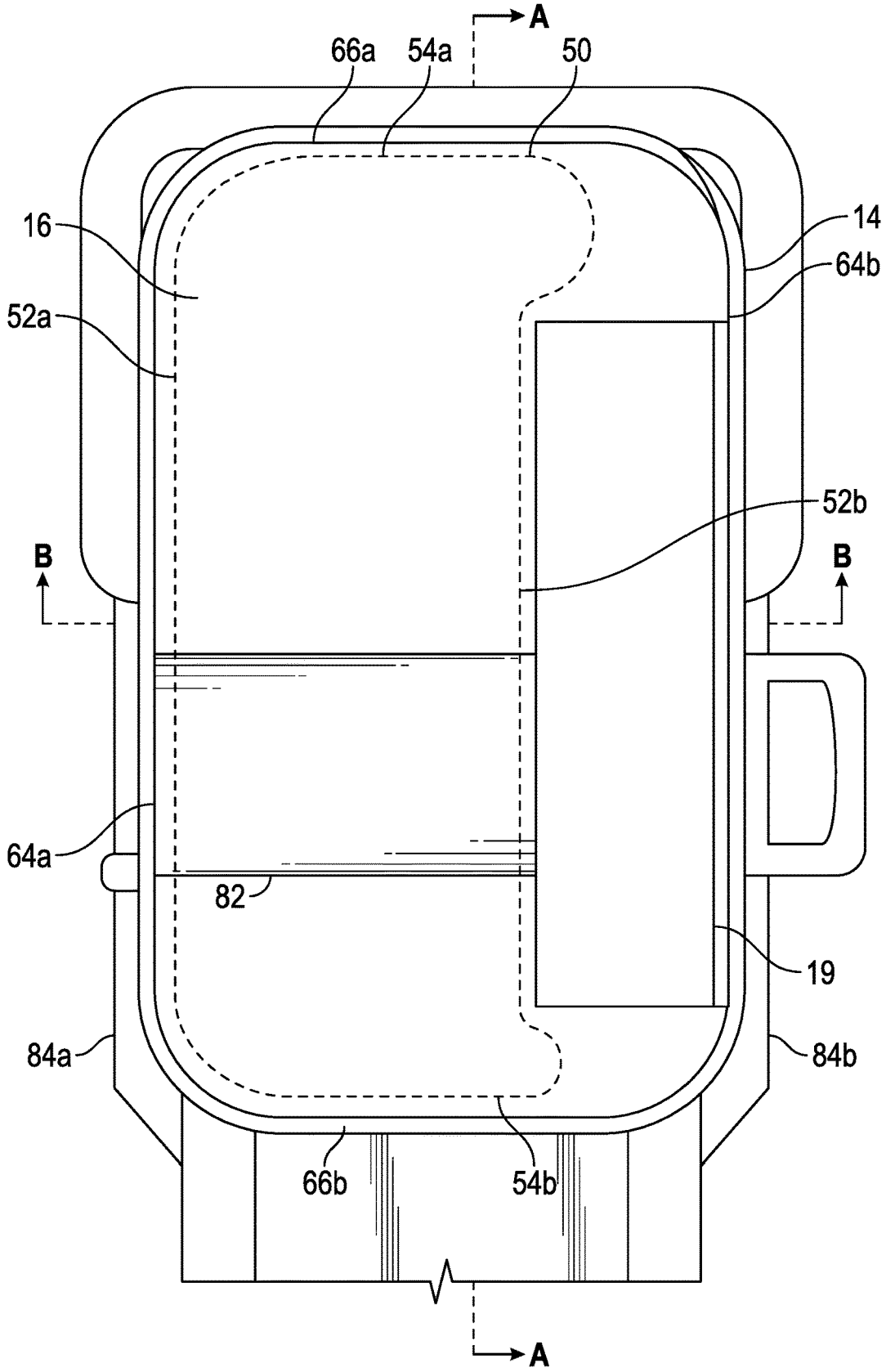
FIG. 4 is a side view, in elevation, of a portion of a chute of the loosefill insulation blowing machine of FIG. 1.

Referring now to FIG. 4, the inlet end 16 of the chute 14 includes longitudinal sides 64*a*, 64*b* and lateral sides 66*a*, 66*b*. The longitudinal sides 64*a*, 64*b* of the inlet end 16 of the chute 14, are configured to be substantially vertical and centered about major longitudinal axis A-A. The lateral sides 66*a*, 66*b* are configured to be substantially horizontal and centered about major lateral axis B-B. In operation, a package of compressed loosefill insulation material (shown schematically in phantom at 50) is fed into the inlet end 16 of the chute 14 in a manner such that the package 50 has a substantially vertical orientation. The term "vertical orientation", as used herein, is defined to mean major face 52*a* of the package 50 is adjacent to the longitudinal side 64*a*, opposing major face 52*b* is adjacent to the substantially vertical-oriented bale guide 19, and opposing minor faces 54*a*, 54*b* of the package 50 are adjacent to the lateral sides 66*a*, 66*b*. Alternatively, the chute 14 can be configured such that the package 50 has a substantially horizontal orientation when fed into the inlet end 16 of the chute 14.

Referring again to FIGS. 1-4, as discussed above, the chute 14 includes a distribution hose storage assembly 80. The distribution hose storage assembly 80 is configured to store a distribution hose 38 within the chute 14 when the blowing machine 10 is not in use. Portions of the distribution hose storage assembly 80 are further configured for removal from the chute 14 when the blowing machine 10 is in use. The distribution hose storage assembly 80 includes a hose hub 82 extending through and attached to opposing flange assemblies 84*a*, 84*b*. Flange assembly 84*a* is rotatably mounted to longitudinal side 64*a* of the chute 14 and flange assembly 84*b* is rotatably mounted to longitudinal side 64*b* of the chute 14.

Figure 5:
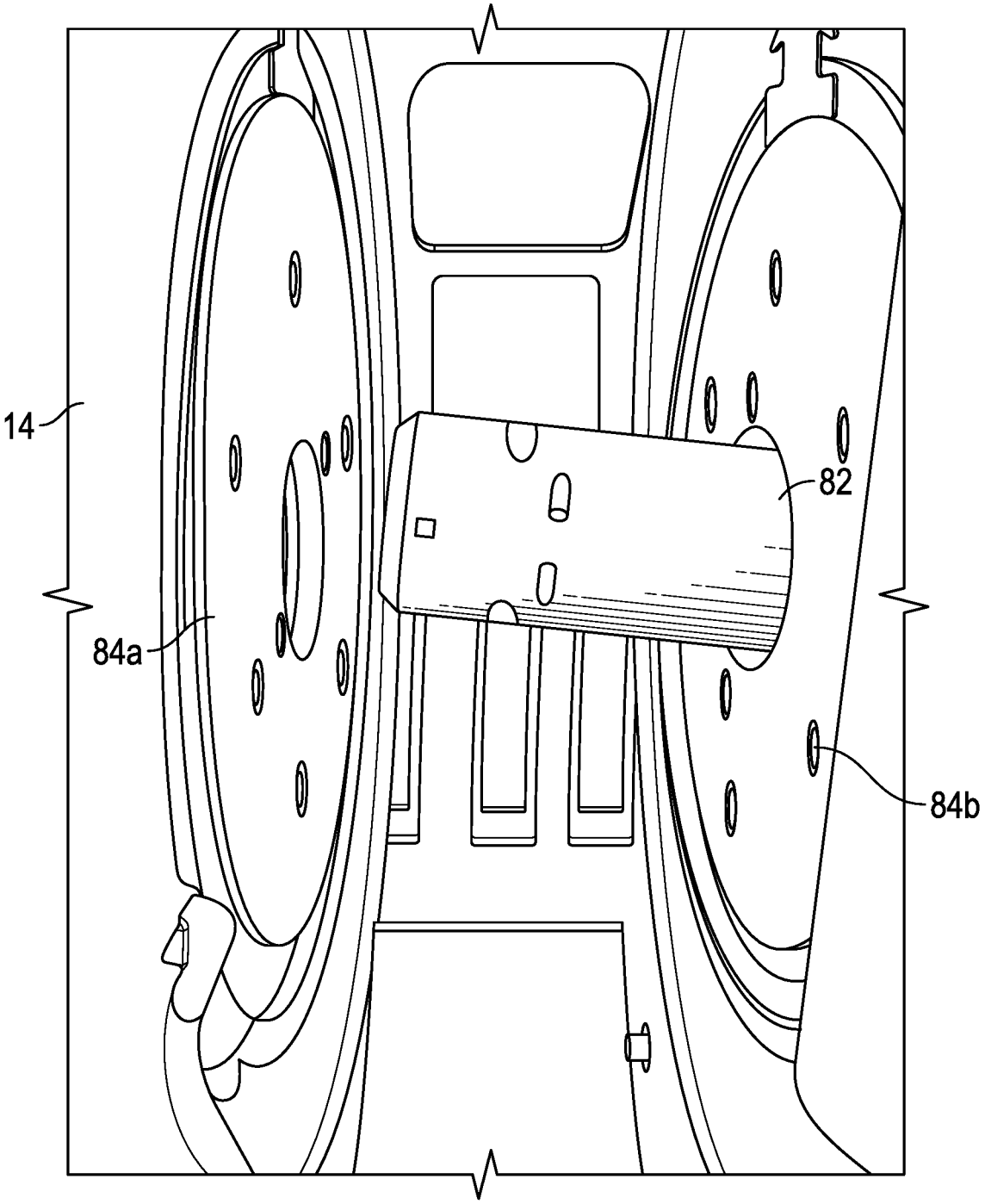
FIG. 5 is a front view, in elevation, of an interior portion of the chute of the loosefill insulation blowing machine of FIG. 1.

Referring now to FIG. 5, portions of the chute 14 are illustrated with the hose hub 82 shown extending partially between the opposing flange assemblies 84*a*, 84*b*. In an installed position, the hose hub 82 extends through the flange 84*b* and through the flange 84*a*. The resulting structure of the hose hub 82 and the opposing flange assemblies 84*a*, 84*b* is rotatably mounted within the interior of the chute 14. In the installed position, the hose hub 82 is configured to receive and support accumulated wrappings of the distribution hose 38.

Figure 6:
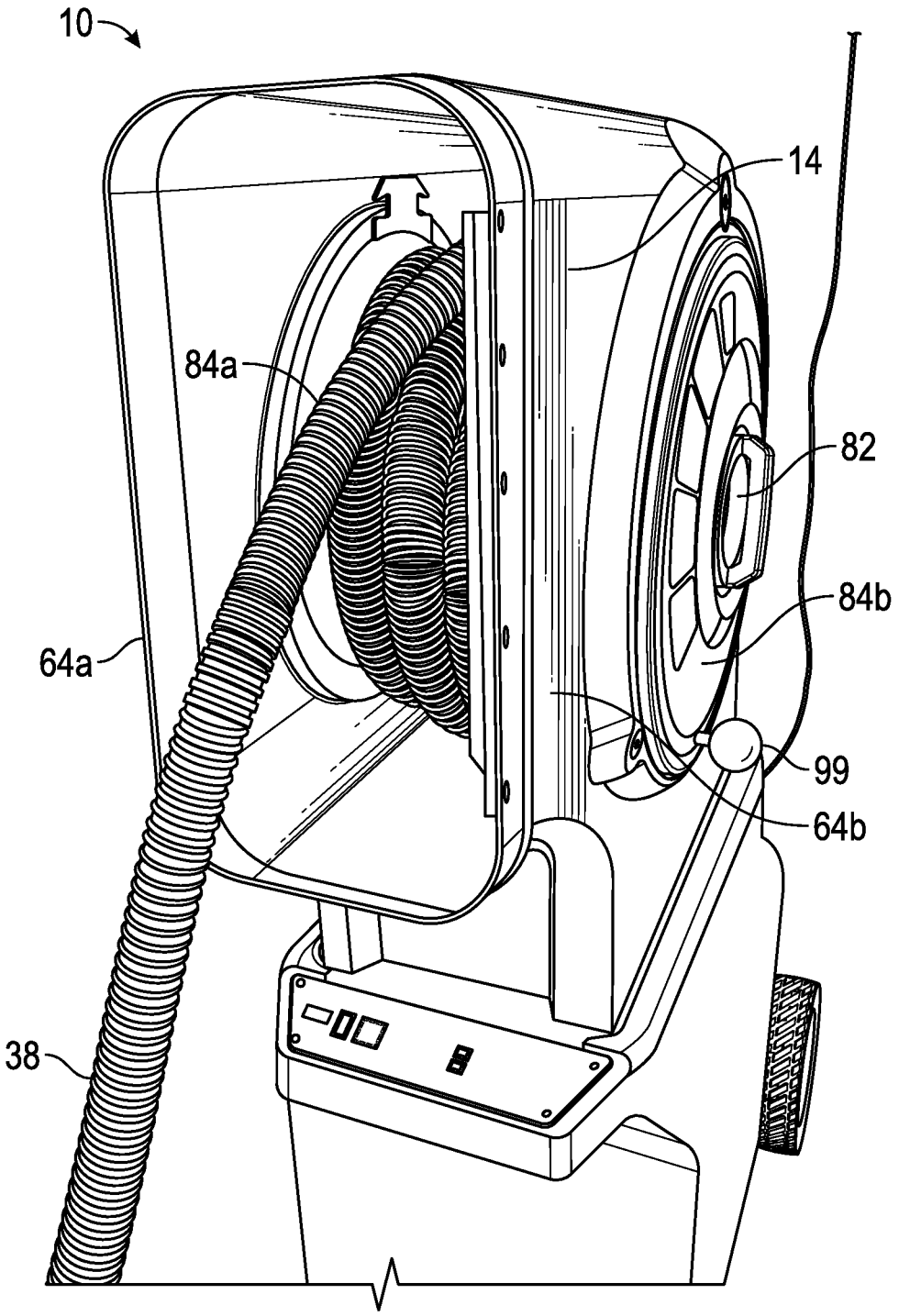
FIG. 6 is a perspective view of the loosefill insulation blowing machine of Figure showing a distribution hose wrapped around a hose hub positioned within the chute.

Referring now to FIG. 6, the blowing machine 10 is illustrated with portions of a distribution hose 38 wrapped around the hose hub 82. The hose hub 82 extends through the flange assembly 84*b*, through the interior of the chute 14 and through the opposing flange assembly 84*a*. Portions of the flange assemblies 84*a*, 84*b* positioned within the interior of the chute 14 are configured to guide the distribution hose 38 onto the hose hub 82 during the wrapping process such that the distribution hose 38 wraps onto the hose hub 82 without extending into other portions of the chute 14.

Figure 7A:
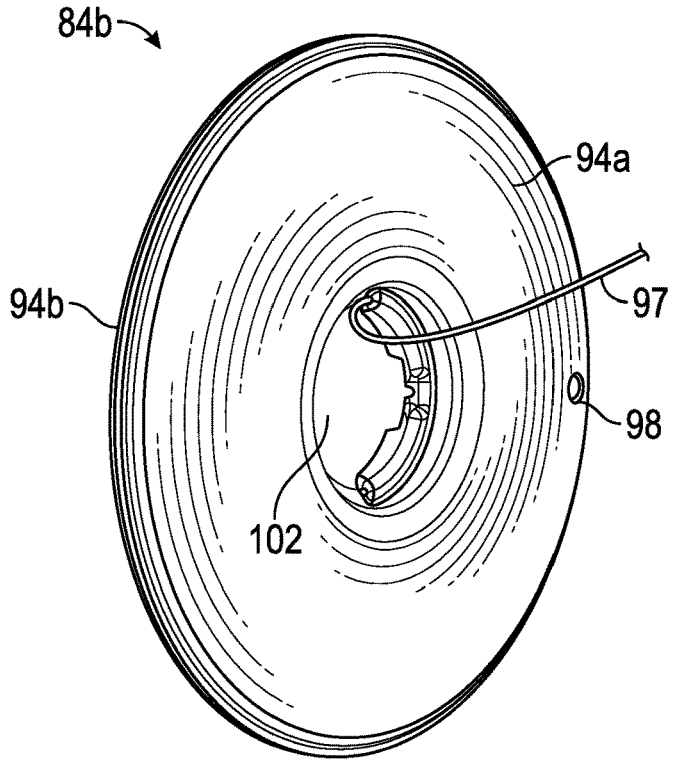
FIG. 7A is a front perspective view of a flange assembly of the loosefill insulation blowing machine of FIG. 1.
Figure 7B:
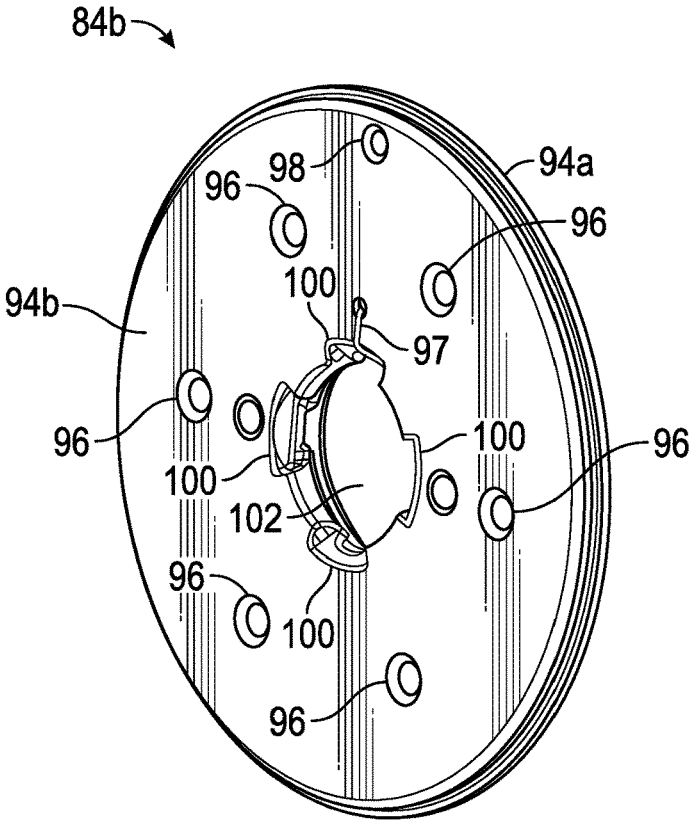
FIG. 7B is a rear perspective view of a flange assembly of FIG. 7A.
Figure 7C:
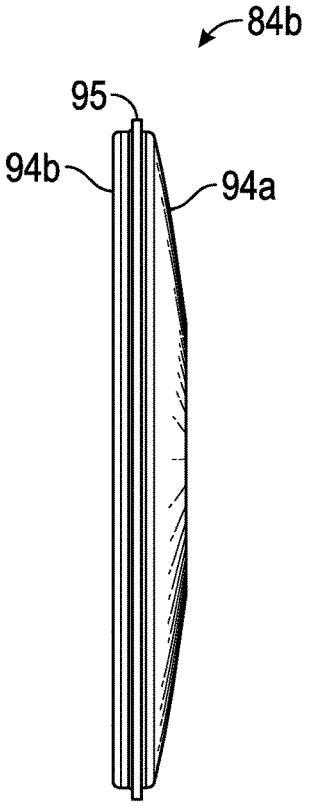
FIG. 7C is a side view of a flange assembly of FIG. 7A.

Referring now to FIGS. 7A, 7B and 7C, the flange assembly 84*b* is illustrated. Flange assembly 84*b* is representative of the flange assembly 84*a*. Flange assembly 84*b* includes an outer disk-shaped segment 94*a* connected to an inner disk-shaped segment 94*b*. The connected segments 94*a*, 94*b* cooperate such that the flange assembly 84*b* can be rotatably mounted within a corresponding aperture (not shown) in the longitudinal side 64*b* of the chute 14. In a similar manner, the connected segments forming flange assembly 84*a* cooperate such that the flange assembly 84*a* can be rotatably mounted within a corresponding aperture (not shown) in the longitudinal side 64*a* of the chute 14. In the illustrated embodiment, the inner disk-shaped segment 94*b* is connected to the outer disk-shaped segment 94*b* with fasteners (not shown) extending through apertures 96 located in the inner disk-shaped segment 94*b*. However, it should be understood that in other embodiments, the outer disk-shaped segment 94*a* can be connected to the inner disk-shaped segment 94*b* with other structures, methods and devices, including the non-limiting examples of clips and clamps.

Figure 9A:
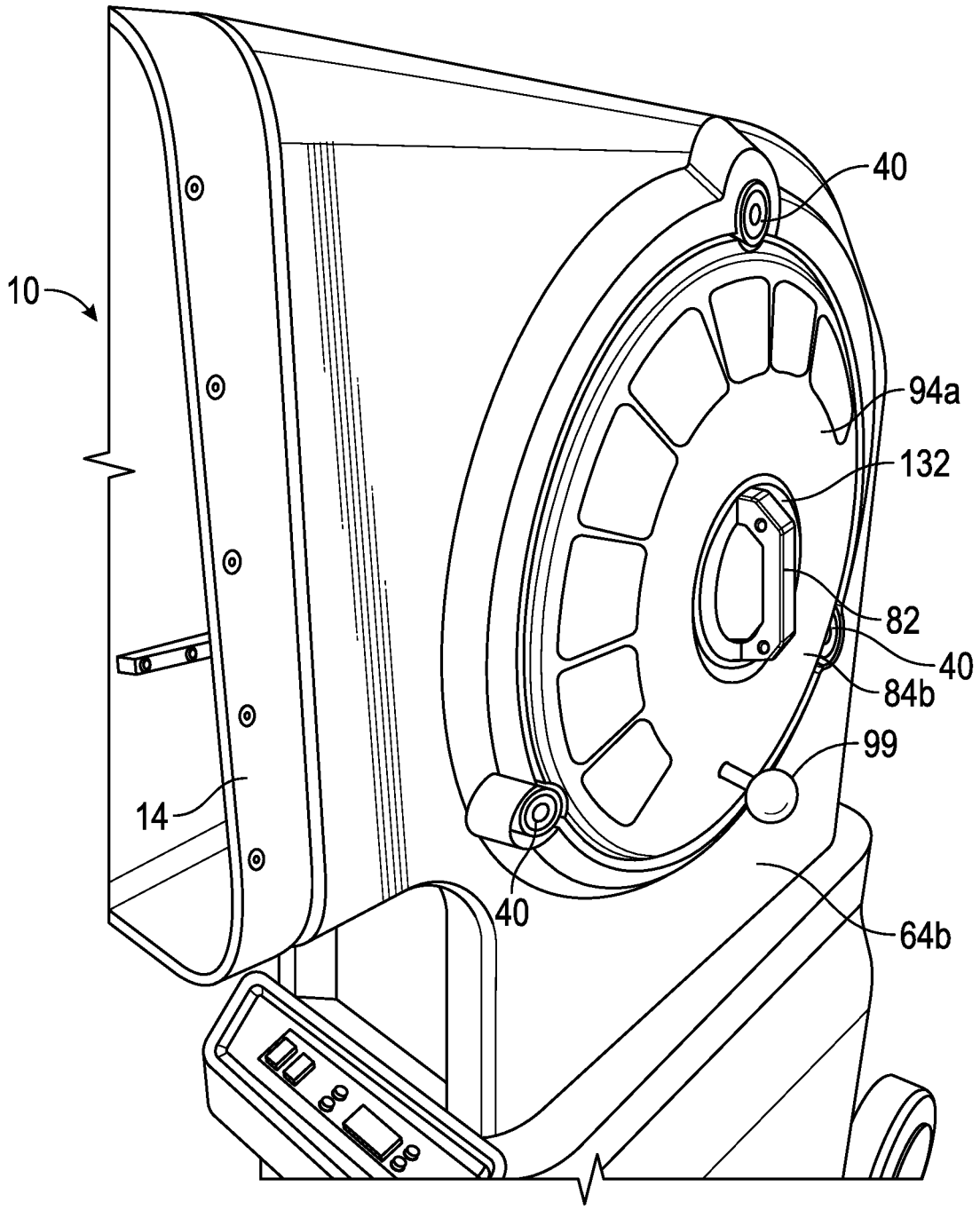
FIG. 9A is a side perspective view of the hose hub and flange assembly of FIG. 5.
Figure 9B:
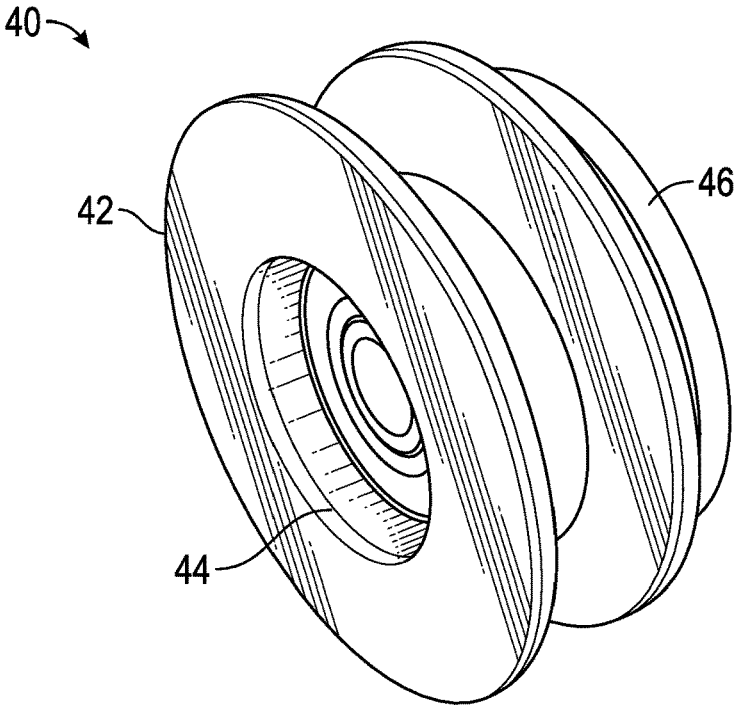
FIG. 9B is a side perspective view of a roller assembly of the loosefill insulation blowing machine of FIG. 1.

Referring again to FIGS. 7A, 7B and 7C, a projection aperture 98 extends through the outer and inner segments 94*a*, 94*b* and is configured to receive a projection 99, as shown in FIGS. 6, 9A and 9B, extending in an outward direction from the outer segment 94*a*. The projection 99 will be discussed in more detail below.

Referring again to FIGS. 7A, 7B and 7C, the inner segment 94*b* includes a plurality of recesses 100. The recesses 100 are configured for a plurality of functions and will be discussed in more detail below.

Figure 8A:
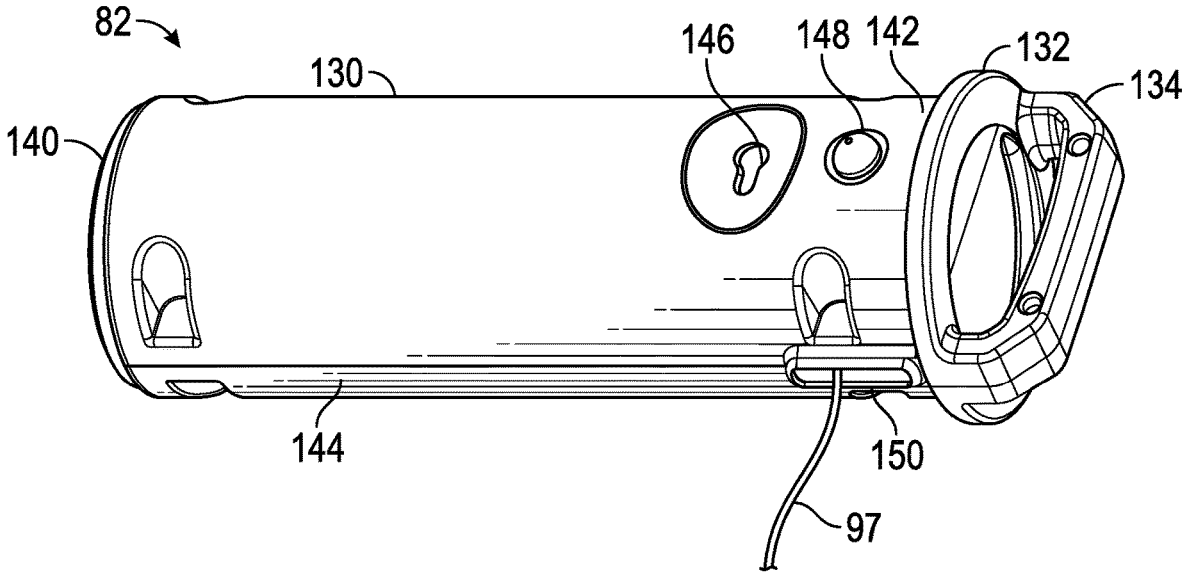
FIG. 8A is a perspective view of a hose hub of the loosefill insulation blowing machine of FIG. 1.
Figure 9C:
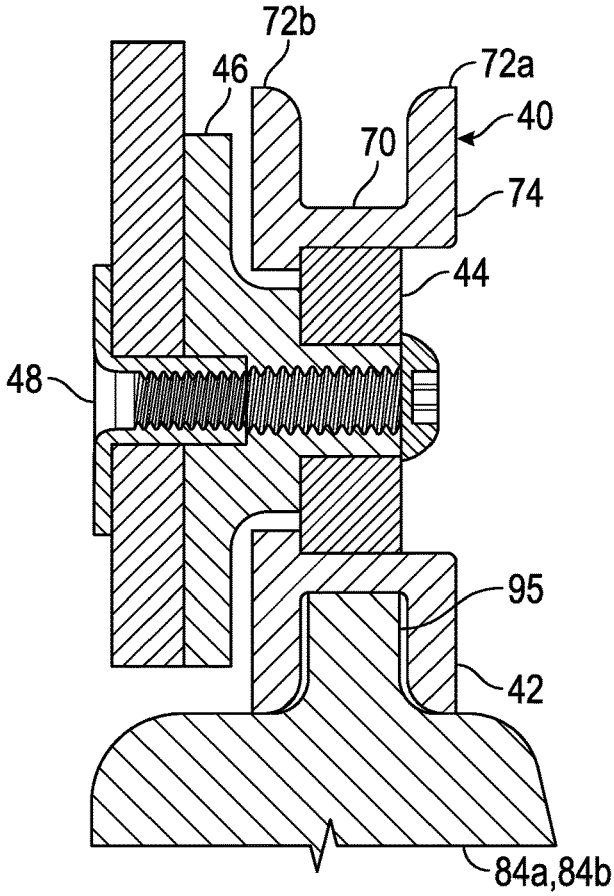
FIG. 9C is a front view, in elevation, of the roller assembly of FIG. 9B supporting a rim of a flange assembly.
Figure 9D:
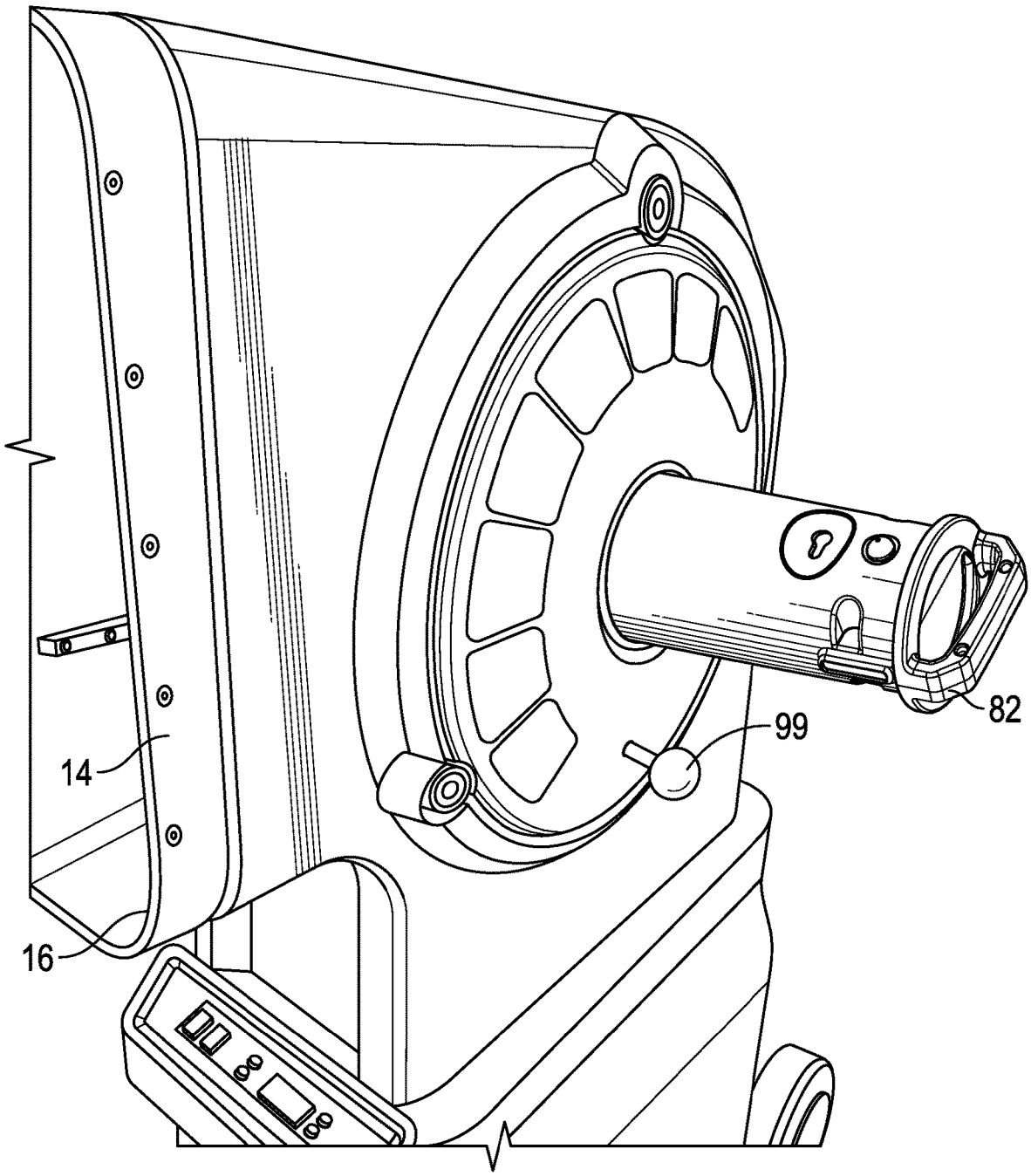
FIG. 9D is a side perspective view of the loosefill insulation blowing machine of FIG. 1 illustrating the removal of the hose hub from the flange assembly.
Figure 9E:
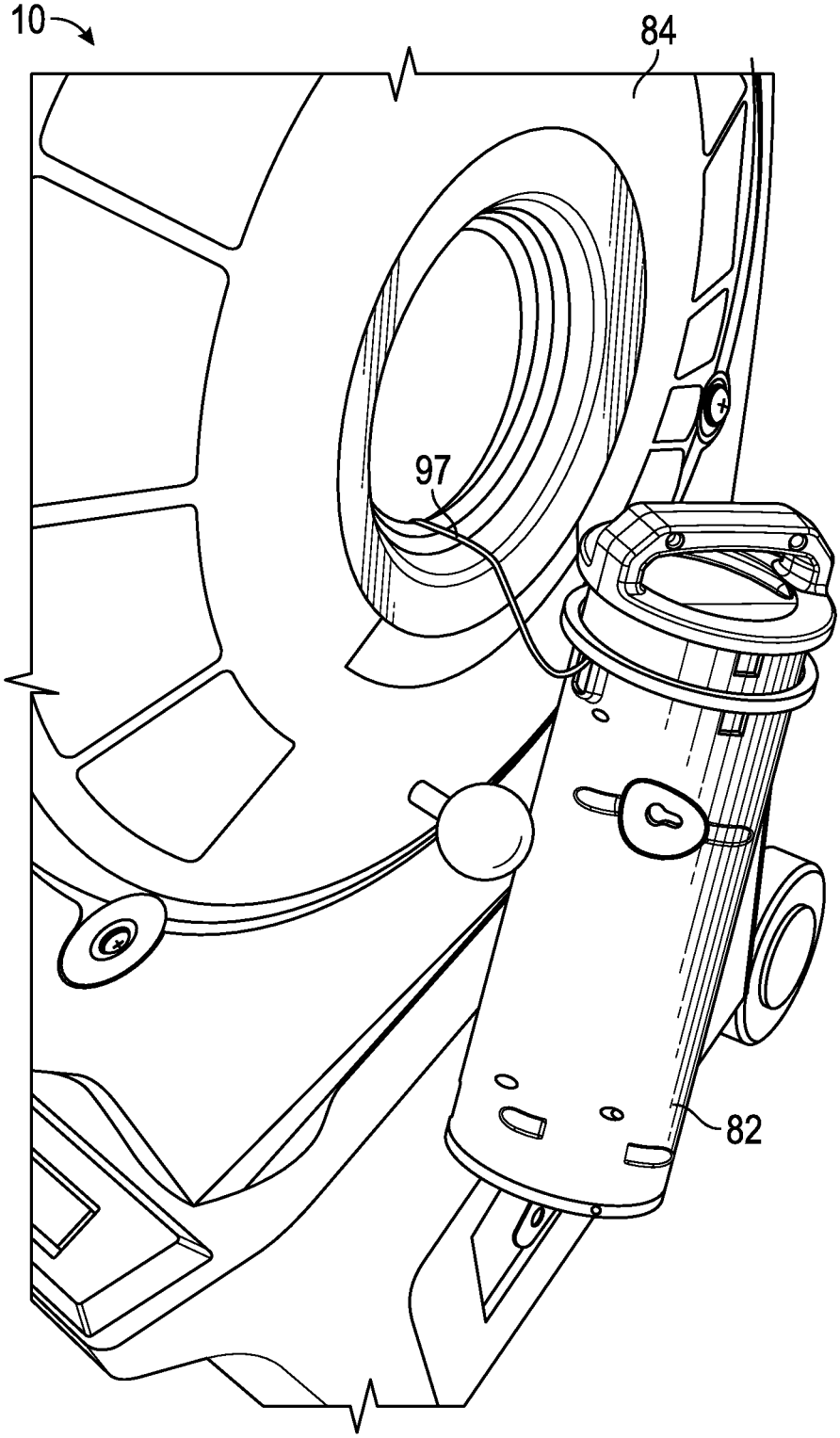
FIG. 9E is a side perspective view of the loosefill insulation blowing machine of FIG. 1 illustrating a tether connecting the hose hub to the blowing machine after the hose hub has been removed from the flange assembly.

Referring now to FIGS. 7A, 7B, 8A and 9E, a tether 97 connects the hose hub 82 to the flange assembly 84*b*. As shown in FIG. 9E, the tether 97 is configured to maintain the connection between the hose hub 82 and the flange assembly 84*b* when the hose hub 82 is removed from the blowing machine 10 in an operational mode. As further shown by FIG. 9E, the tether 97 is configured to allow the hose hub 82 to freely hang at the side of the blowing machine 10.

Referring now to FIGS. 7A, 7B and 8A, a first end of the tether 97 is connected to the inner disk-shaped segment 94*b* of the flange assembly 84*b*. The tether 97 extends through a hub aperture 102 and a second end of the tether 97 extends into the keyed structure 150 of the hose hub 82. The second end of the tether 97 is connected internal to the hose hub 82.

In the embodiment illustrated in FIGS. 7A, 7B, 8A and 9E, the tether 97 has the form of an elastic member, such as the non-limiting example of a bungy-style cord. However, it should be appreciated that in other embodiments, the tether 97 can have other forms, such as for example, paracord.

Referring now to FIG. 8A, the hose hub 82 is illustrated. The hose hub 82 includes a body 130, a rim 132 and a hub handle 134. The body 130 includes a first end 140, a second end 142 and an interim section 144 extending therebetween. The hose hub 82 is configured such that in an installed position within the chute 14, the first end 140 seats with the flange assembly 84*a*, the second end seats with the flange assembly 84*b* and the interim section 144 is exposed within the interior of the chute 14.

Referring again to FIG. 8A, the body 130 has a circular cross-sectional shape configured to receive and support accumulated wrappings of the distribution hose 38. However, it should be appreciated that in other embodiments, the body 130 can have other cross-sectional shapes sufficient to receive and support accumulated wrappings of the distribution hose 38.

Referring again to FIG. 8A, the body 130 includes an alternating plurality of opposing projections 148 and a plurality of opposing key structures 150 (a single projection 148 and a single key 150 are shown in FIG. 8A for purposes of clarity). The opposing projections 148 are configured for seating within opposing recesses 100 of the inner disk-shaped segment 94*b* of the flange assembly 84*b*, when the hose hub 82 is in an installed position. In the illustrated embodiment, the projections 148 are spring-loaded structures configured to assume a depressed arrangement upon insertion into the flange assembly 84*b*. The projections 148 return to an extended arrangement after the projections 148 extend through the flange assembly 84*b*. Upon seating with the opposing recesses 100 of the flange assembly 84*b*, the projections 148 operate to connect the hose hub 82 to the flange assembly 84*b* with a "snap" connection. However, it should be appreciated that in other embodiments, the hose hub 82 can be connected to the flange assembly 84*b* with other structures, methods and devices, including the non-limiting examples of clips and clamps.

Referring again to FIG. 8A, the key structures 150 are configured for seating within opposing recesses 100 of the flange assembly 84*b* when the hose hub 82 is in an installed position. In the seated position with the opposing recesses 100, the key structures 150 are configured to providing a positive locking feature, thereby ensuring the hose hub 82 and the flange assembly 84*b* rotate together to wrap the distribution hose 38 around the hose hub 82. In the illustrated embodiment, the key structures 150 are integrally formed with the body 130. However, in alternate embodiments, the key structures 150 can be formed from discrete components and attached to the body 130.

Referring again to FIG. 8A, the rim 132 extends radially from the second end 142 of the body 130 and is configured to seat against the outer disk-shaped segment 94*a* of the flange assembly 84*b*. When seated, the rim 132 fixes the axial depth of the insertion of the hose hub 82 into the chute 14. The rim 132 can have any desired diameter and configuration sufficient to seat against the outer disk-shaped segment 94*a* of the flange assembly 84*b* and fix the axial depth of the insertion of the hose hub 82 into the chute 14.

Referring again to FIG. 8A, the hub handle 134 is configured to facilitate ready insertion and removal of the hose hub 82 from the chute 14. The hub handle 134 can have any desired structure and configuration sufficient to facilitate ready insertion and removal of the hose hub 82 from the chute 14.

Figure 8B:
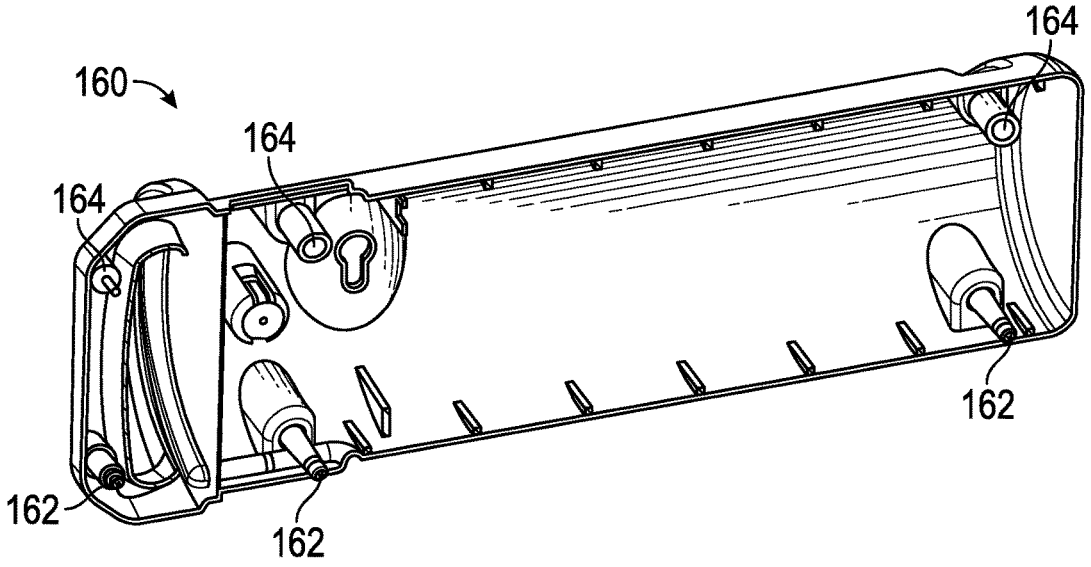
FIG. 8B is a perspective view of a clamshell structure forming a portion of the hose hub of FIG. 8A.

Referring again to FIG. 8A, in certain embodiments the hose hub 82 can be formed from mating and opposing clamshell-type structures. Referring now to FIG. 8B, one embodiment of the clamshell-type structure used to form the hose hub 82 is illustrated at 160. The clamshell structure 160 is joined with an opposing similar clamshell structure (not shown) to form the hose hub 82. The clamshell structure 160 includes spaced apart mating male coupling members 162 and female coupling members 164. The coupling members 162, 164 are configured as alignment devices and fastening mechanisms when mated with opposing coupling members located on the opposing clamshell structure. In other embodiments, it should be appreciated that the opposing clamshell structures can be joined and fastened together with other structures, methods and devices, such as for example clips, clamps and adhesives.

Referring now to FIG. 9A, the blowing machine 10 is shown in a storage mode. In the storage mode, the rim 132 of the hose hub 82 is seated against the outer disk-shaped segment 94*a* of the flange assembly 84*b* and the hose hub 82 extends through the interior of the chute 14 and through the opposing flange assembly (not shown). The distribution hose 38 is wrapped around the hose hub 82, as shown in FIG. 6 and described above.

Referring again to FIG. 9A, flange assembly 84*b* is configured to rotate on a plurality of roller assemblies 40 (while not shown in FIG. 9A, flange assembly 84*a* is also configured to rotate on a plurality of roller assemblies 40). The roller assemblies 40 are positioned in the longitudinal sides 64*a*, 64*b* of the chute 14 and are configured to support the flange assemblies 84*a*, 84*b* as the flange assemblies 84, 84*b* rotate during the wrapping of the distribution hose 38 around the hose hub 82.

Referring now to FIG. 9B, a representative roller assembly 40 is illustrated. The roller assembly 40 includes a roller 42, a bearing 44, a bearing flange 46 and mounting hardware 48. The roller 42 includes a concave-shaped recess 70 defined by opposing legs 72*a*, 72*b* extending radially from a roller hub 74. The concave-shaped recess 70 is configured to receive and guide a rim 95 extending radially from the flange assemblies 84*a*, 84*b*, as shown in FIG. 7C.

Referring again to FIGS. 9B and 9C, the bearing 44 is mounted internal to the roller hub 74 and is configured to reduce the rotational friction of the roller assemblies 40. The bearing 44 can have any desired structure, including the non-limiting example of a ball bearing, sufficient to reduce the rotational friction of the roller assemblies 40.

Referring now to FIG. 9C, the bearing flange 46 is configured to support the roller assembly 40 in an installed position in the longitudinal sides 64*a*, 64*b* of the chute 14 and can have any desired configuration. The mounting hardware 48 is configured to retain the roller assemblies 40 in an installed position. In the illustrated embodiment, the mounting hardware 48 includes a threaded fastener and a threaded nut. However, in other embodiments, the mounting hardware 48 can include other mechanisms, devices and structures, such as for example clips and clamps, sufficient to retain the roller assemblies 40 in an installed position in the longitudinal sides 64*a*, 64*b* of the chute 14.

The roller assemblies 40 advantageously allow the flange assemblies 84*a*, 84*b* to rotate with a low coefficient of rotational friction as the distribution hose 38 is wrapped around the hose hub 82. While the embodiment of the blowing machine shown in FIG. 9A is illustrated with the roller assemblies 40, it should be appreciated that other structures can be used to allow the flange assemblies 84*a*, 84*b* to rotate with a low coefficient of rotational friction as the distribution hose 38 is wrapped around the hose hub 82.

Referring now to FIG. 9B, the blowing machine 10 is shown preparing for an operational mode. When preparing for an operational mode, the hose hub 82 is removed from the chute 14, thereby allowing the inlet end 16 of the chute 14 to readily receive a package of compressed loosefill insulation material.

Figure 10:
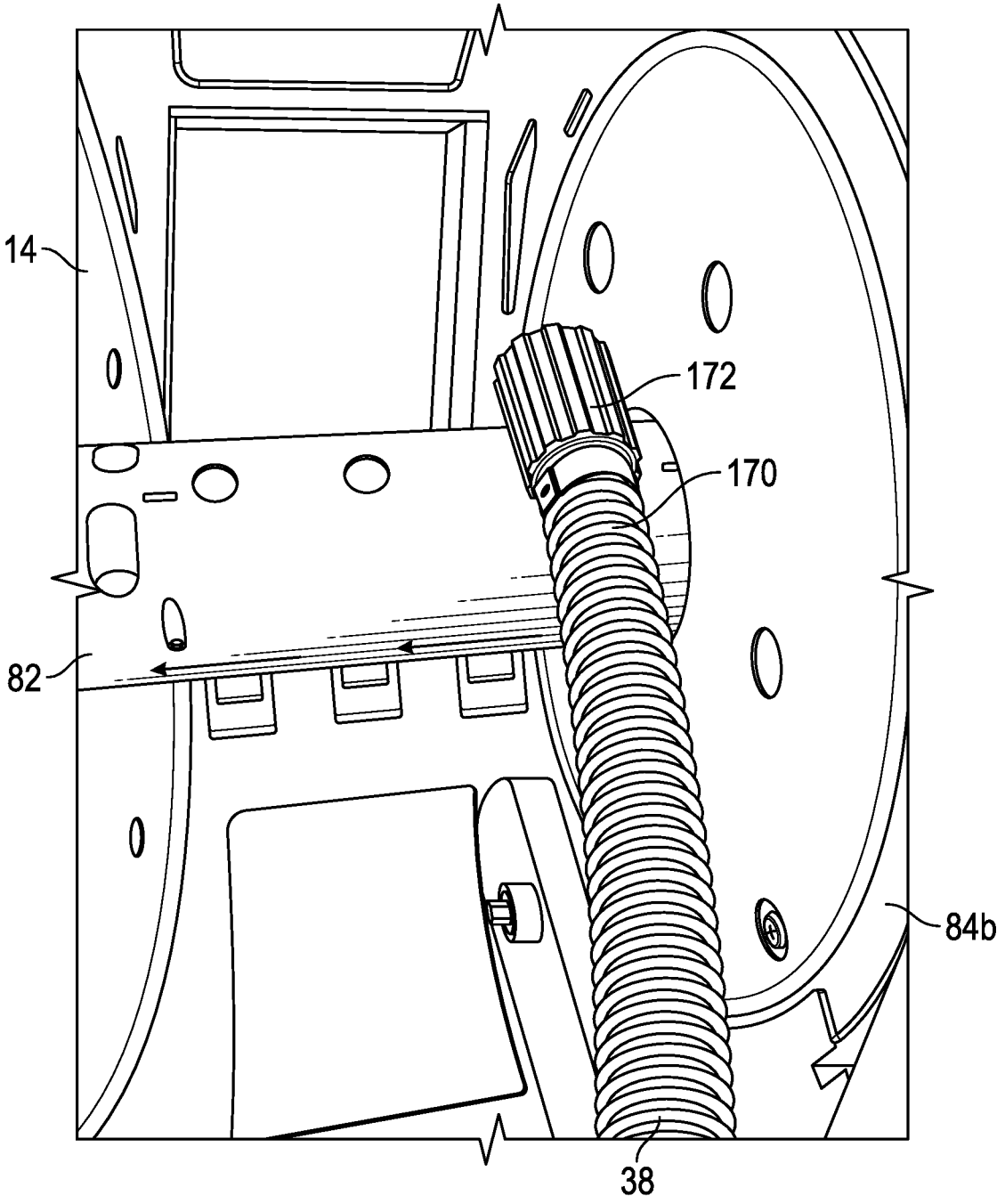
FIG. 10 is a front perspective view of a portion of the chute of the loosefill insulation blowing machine of FIG. 1, illustrating a first end of a distribution hose connected to the hose hub.

Referring now to FIG. 10, a first end 170 of the distribution hose 38 is received by a coupling fixture 172. The coupling fixture 172 includes a male structure (not shown) extending from the coupling fixture 172 and configured to mate with the recess 146 located on the interim section 130 of the hose hub 82, as shown in FIG. 8A. The male structure and the recess 146 are configured to secure the first end 170 of the distribution hose 38 to the hose hub 82 during the wrapping process. In the illustrated embodiment, the male structure is a ball mounted to a stand and the recess 146 has the form of a keyhole slot. However, in other embodiments, the male structure and the recess 146 can have other desired forms sufficient secure the first end 170 of the distribution hose 38 to the hose hub 82 during the wrapping process.

Referring now to FIGS. 6, 9A and 9B, rotational actuation of the flange assemblies 84*a*, 84*b* and the hose hub 82 are accomplished by rotation of the projection 99 extending from flange assembly 84*b*. In certain instances, the projection 99 can have the form of an attachable handle or a knob. In other instances, the projection 99 can have other desired forms and structures.

Referring now to FIGS. 1, 2, 3, 4 and 9B, operation of the removable hose hub 82 will now be described. In a first step as shown in FIG. 2, the blowing machine 10 is changed from a storage mode to an operational mode as the distribution hose 38 is unwrapped from the rotatable hose hub 82. The distribution hose 38 is removed in its entirety from the chute 14. Referring now to FIGS. 2 and 3 in a next step, one end of the distribution hose 38 is connected to the machine outlet 32. In this position, the distribution hose 38 is ready to receive the airstream 33.

Referring now to FIG. 9B in a next step, the hose hub 82 is disconnected from the flange assemblies 84*a*, 84*b* and removed from the chute 14. With the hose hub 82 removed from the chute 14, the chute 14 is ready to receive a package of compressed loosefill insulation material.

Referring now to FIG. 9 in a next step, the blowing machine 10 is operated as described above, to condition and distribute conditioned loosefill insulation material within an airstream 33 within the distribution hose 38 to an insulation cavity. The insulation cavity can have any desired location, such as the non-limiting example of an attic.

Referring now to FIGS. 9B and 5, once the blowing operation of the blowing machine 10 is completed, the blowing machine 10 is prepared for the storage mode by reinstallation of the hose hub 82. The hose hub 82 is inserted into and connected to the flange assemblies 84*a*, 84*b* as described above. Once the hose hub 82 is reinstalled, a first end 170 of the distribution hose 38 is affixed to the hose hub 82 such as to facilitate wrapping of the distribution hose 38 around the hose hub 82 as the flange assemblies 84*a*, 84*b* and the hose hub 82 are rotated. Once the distribution hose 38 is wrapped onto the hose hub 82, the storage mode of the blowing machine 10 is completed.

The removable hose hub 82 in the chute 14 is configured to receive and store a distribution hose 38 within the chute 14. Storing the distribution hose 38 within the chute 14 provides for significant benefits, including 1) allowing for a compact storage unit, 2) providing for ease of movement of the blowing machine, and 3) improving the efficiency and speed of the installation of the conditioned loosefill insulation material by reducing the steps required for setup of the blowing insulation machine.

The principle and mode of operation of the loosefill insulation blowing machine having a removable hose hub have been described in certain embodiments. However, it should be noted that the loosefill insulation blowing machine having a removable hose hub may be practiced otherwise than as specifically illustrated and described without departing from its scope.

What is claimed is:

1. A machine for distributing blowing insulation material from a package of compressed loosefill insulation material, the machine comprising:

a chute having an inlet end and outlet end, the inlet end configured to receive the package of compressed loosefill insulation material, the chute further having a removable hose hub extending within the interior of the chute, the removable hose hub configured for wrapping with a distribution hose; and a lower unit configured to receive the compressed loosefill insulation material exiting the outlet end of the chute, the lower unit including a plurality of shredders and a discharge mechanism, the discharge mechanism configured to discharge conditioned loosefill insulation material into an airstream.

2. The machine of claim 1, wherein the removable hose hub is rotatable.

3. The machine of claim 1, wherein the removable hose hub is connected to opposing flange assemblies.

4. The machine of claim 3, the opposing flange assemblies rotate with the removable hose hub.

5. The machine of claim 4, wherein the inlet end of the chute is defined by two vertical longitudinal sides extending between two horizontal lateral sides, and wherein the rotation of the opposing flange assemblies are supported by roller assemblies positioned in the longitudinal sides of the chute.

6. The machine of claim 3, wherein the inlet end of the chute is defined by two vertical longitudinal sides extending between two horizontal lateral sides, and wherein the opposing flange assemblies are positioned in the longitudinal sides of the chute.

7. The machine of claim 3, wherein in an installed position in the chute, the removable hose hub prevents insertion of the package of compressed loosefill insulation material into the chute.

8. The machine of claim 3, wherein the flange assemblies include a plurality of recesses positioned within the chute.

9. The machine of claim 8, wherein the recesses are configured to receive projections radiating from the removable hose hub.

10. The machine of claim 1, wherein the removable hose hub includes a recess configured to mate with a distribution hose coupling.

11. The machine of claim 1, wherein a tether is configured to connect the removable hose hub to the machine after the hose hub has been removed from the machine.

12. A machine for distributing blowing insulation material from a package of compressed loosefill insulation material, the machine comprising:

a chute having an inlet end and outlet end, the inlet end configured to receive the package of compressed loosefill insulation material;

a removable hose hub installed in the chute; and a lower unit configured to receive the compressed loosefill insulation material exiting the outlet end of the chute, the lower unit including a plurality of shredders and a discharge mechanism, the discharge mechanism configured to discharge conditioned loosefill insulation material into an airstream;

wherein the machine is configured for a storage mode with the hose hub installed in the chute and a distribution hose wrapped around the hose hub; and wherein the machine is configured for an operational mode with the hose hub removed from the machine.

13. The machine of claim 12, wherein the removable hose hub is connected to opposing rotatable flange assemblies.

14. The machine of claim 12, wherein in an installed position in the chute, the removable hose hub prevents insertion of the package of compressed loosefill insulation material into the chute.

15. The machine of claim 12, wherein the removable hose hub includes a recess configured to mate with a distribution hose coupling.

16. A method of using and storing a machine for distributing blowing insulation material from a package of compressed loosefill insulation material, the method comprising the steps of:

configuring the machine with a chute, a hose hub and a lower unit, the chute having an inlet end and outlet end, the inlet end configured to receive the package of compressed loosefill insulation material, the hose hub configured to receive and support accumulated wrappings of a distribution hose, the lower unit configured to receive the compressed loosefill insulation material exiting the outlet end of the chute, the lower unit including a plurality of shredders and a discharge mechanism, the discharge mechanism configured to discharge conditioned loosefill insulation material into an airstream;

configuring the machine for a storage mode with the hose hub installed in the chute and a distribution hose wrapped around the hose hub; and configuring the machine for an operational mode with the hose hub removed from the machine.

17. The method of claim 16, including the step of connecting the hose hub to opposing rotatable flange assemblies to the chute.

18. The method of claim 16, including the step of positioning the opposing flange assemblies in longitudinal sides of the chute.

19. The method of claim 16, wherein in an installed position in the chute, the hose hub prevents insertion of the package of compressed loosefill insulation material into the chute.

20. The method of claim 16, including the step of mating a distribution hose coupling with a recess in the hose hub to facilitate wrapping of the distribution hose around the hose hub.

* * * * *